United States Patent [19]

Crouch

[11] Patent Number: 4,784,316

[45] Date of Patent: Nov. 15, 1988

[54] CARTON CARRYING HANDLE

[75] Inventor: Elmoe Crouch, Franklin, Ohio

[73] Assignee: The C. W. Zumbiel Co., Cincinnati, Ohio

[21] Appl. No.: 5,917

[22] Filed: Jan. 21, 1987

[51] Int. Cl.[4] ..... B65D 5/46

[52] U.S. Cl. ..... 229/52 B; 206/141; 206/427

[58] Field of Search ..... 229/40, 52 B; 206/141, 206/427, 434

[56] References Cited

U.S. PATENT DOCUMENTS

| | | | |
|---|---|---|---|
| 2,019,307 | 10/1935 | Hill et al. | 229/52 B |
| 2,312,598 | 3/1943 | Sprague | 229/52 B |
| 2,718,301 | 9/1955 | Palmer | 229/52 B |
| 2,718,311 | 9/1955 | Palmer | 229/52 B |
| 2,723,027 | 11/1955 | Guyer | 229/52 B |
| 2,802,615 | 8/1957 | Radket | 229/52 B |
| 2,872,036 | 2/1959 | Forrer | 229/40 |
| 3,019,957 | 2/1962 | Palmer | 229/16 R |
| 3,112,856 | 12/1963 | MacIntosh et al. | 229/52 B |
| 3,181,772 | 5/1965 | Collins et al. | 229/52 B |
| 3,227,353 | 1/1966 | Bump | 229/52 B |
| 3,371,846 | 3/1968 | Detzel | 229/40 |
| 3,540,581 | 11/1970 | Koolnis | 229/52 B |
| 3,912,157 | 10/1975 | Graser | 229/40 |
| 4,155,449 | 5/1979 | Bryne | 206/427 |
| 4,214,660 | 7/1980 | Hunt, Jr. | 206/427 |
| 4,222,485 | 9/1980 | Focke | 206/141 |
| 4,340,170 | 7/1982 | Montealegre | 229/52 B |
| 4,405,078 | 9/1983 | Dutcher et al. | 229/52 B |
| 4,478,334 | 10/1984 | Graser | 206/427 |
| 4,558,816 | 12/1985 | Wood | 229/52 B |
| 4,588,084 | 5/1986 | Holley, Jr. | 229/52 B |
| 4,637,515 | 1/1987 | Wilson et al. | 206/427 |
| 4,653,686 | 3/1987 | Wood et al. | 229/52 B |
| 4,706,876 | 11/1987 | Wilson | 229/52 B |

FOREIGN PATENT DOCUMENTS

| | | | |
|---|---|---|---|
| 697701 | 11/1964 | Canada | 229/52 B |
| 712905 | 7/1965 | Canada | 229/52 B |
| 741189 | 8/1966 | Canada | 229/52 B |
| 1034098 | 7/1978 | Canada | 229/52 BC |
| 1240549 | 7/1971 | United Kingdom | 229/52 B |
| 1602857 | 5/1978 | United Kingdom | 229/52 B |

*Primary Examiner*—Stephen Marcus
*Assistant Examiner*—Gary E. Elkins
*Attorney, Agent, or Firm*—Wood, Herron & Evans

[57] ABSTRACT

A carton carrying handle particularly adapted for use with a wraparound type carton in which cans, e.g., soft drink or beer cans are sold. The handle includes a handle flap defined in the carton's top panel by a traverse breakaway cut line spaced from a traverse fold line, both lines extending across that top panel from side edge to side edge, and by breakaway cut lines co-extensive with the side edges of the top panel, so as to provide a handle hole with a length equal to the width of the top panel, and with a width sufficient to permit a user's fingers to be received through the hole underneath that top panel. Preferably the handle flap is separable into two sub-flaps by means of a longitudinal breakaway cut line that extends between the transverse cut line and the handle flap's hinge line, the hinge lines for the two sub-flaps being co-axial one with the other. Accordingly, and when the carton's user wishes to snap open the handle flap, the handle flap breaks away from the top panel along the longitudinal end cut lines and the transverse cut line, as well as the longitudinal center cut line, to define the two sub-flaps which pivot or hinge underneath the top panel on the transverse hinge line.

5 Claims, 1 Drawing Sheet

CARTON CARRYING HANDLE

This invention relates to cartons. More particularly, this invention relates to a carrying handle for a carton.

In the marketing of soft drinks and beer, it is well known to sell those retail consumer products in cans which are grouped together in six packs or twelve packs. Particularly in the case of twelve can packs it is common to package the cans in cartons so as to make it easier to handle the product for the wholesaler and the retailer, as well as the retail consumer.

There are any number of different types of can cartons known to the prior art. But one particular type that has found significant commercial success over the years is a so-called wraparound carton. In a wraparound carton a number of cans, e.g., twelve, are wrapped in a paperboard box or carton comprised of top and bottom wall panels, side wall panels, and end flaps on each end. The end flaps at each end are sealed one to the other, thereby providing a closed or sealed package or carton for the cans. Now with the wraparound can carton package so formed, it is desirable to provide a carrying handle so the retail consumer can carry the carton. There are any number of different carrying handles known to the wraparound carton art. But the overall purpose of such carton handles is to provide an easy to use handle that is structurally sound so the consumer can pick up and carry the wraparound carton simply through use of the handle structure.

Accordingly, it has been the primary objective of this invention to provide a novel carrying handle for a carton and, particularly, for a wraparound type carton, where the handle's structural components are formed directly from the top panel of the carton. And with this type handle, it is the particular objective of this invention to provide an improved carrying handle structure which maintains the structural integrity of the wraparound carton through the distribution chain until it is chosen by a retail consumer, which is very easy to render usable, and to use, by the retail consumer once the carton has been so chosen, and which does not adversely impact on the structural integrity of the carton when the handle is punched out of the carton's top panel by the user.

In accord with these objectives, the carrying handle for a carton of this invention is particularly adapted for use with a wraparound type carton in which cans, e.g., soft drink or beer cans, are sold. The handle includes a handle flap defined in the carton's top panel by a transverse breakaway cut line spaced from a transverse fold line, both lines extending across that top panel from side edge to side edge, and by breakaway end cut lines coextensive with the side edges of the top panel, so as to provide a handle hole with a length equal to the width of the top panel, and with a width sufficient to permit a user's fingers to be received through the hole underneath that top panel. Preferably the handle flap is separable into two sub-flap by means of a longitudinal breakaway cut line that extends between the transverse cut line and the handle flap's hinge line, the hinge lines for the two sub-flaps being co-axial one with the other. Accordingly, and when the carton's user wishes to snap open the handle flap, the handle flap breaks away from the top panel along the longitudinal end cut lines and the transverse cut line, as well as the longitudinal center cut line, to define the two sub-flaps which pivot or hinge underneath the top panel on the transverse hinge line.

Other objectives and advantages of the invention will be more apparent from the following detailed description taken in conjunction with the drawings in which.

Figure 1:
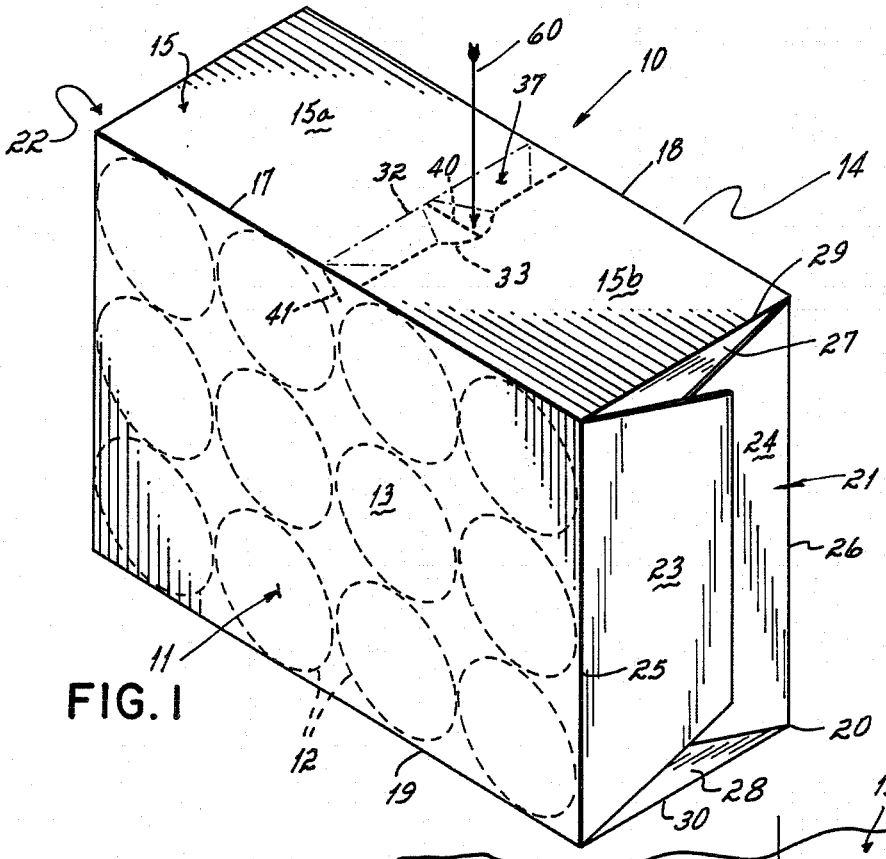
FIG. 1 is a perspective view of a wraparound type carton having a carrying handle in accord with the principles of this invention, the handle being in unused configuration.
Figure 3:
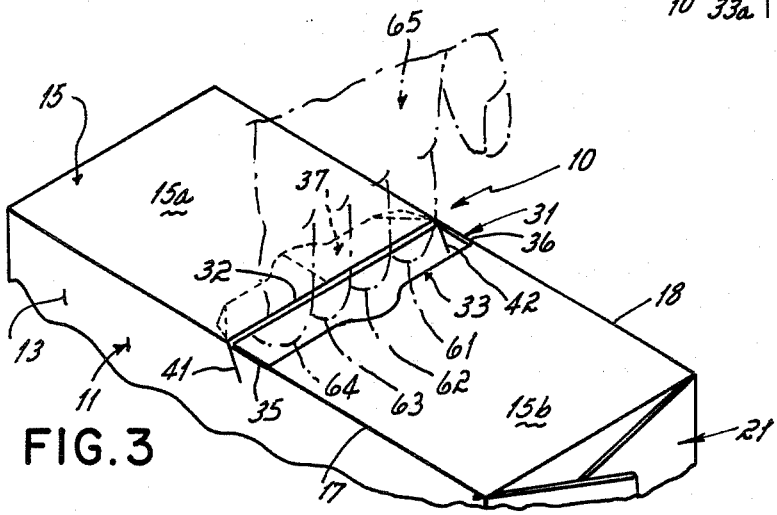

The carrying handle 10 of this invention is adapted for use with a wraparound carton 11 as particularly shown in FIGS. 1 and 3. The wraparound carton 11 may be filled with, for example, cans 12 of soft drink or beer.

The wraparound carton 11 basically includes opposed side wall panels 13, 14, a top wall panel 15, and a bottom wall panel 16, these panels all being foldably connected along side fold lines 17–20. Also, the carton 11 includes, on each end 21, 22, a pair of overlapping end panels 23, 24 that hinge to end fold lines 25, 26 of respective side wall panels 13, 14. Each end panel 23, 14 pair cooperates with top 27 and bottom 28 dust panels that are hingedly connected to end fold lines 29, 30 of the top 15 and bottom 16 wall panels. The end panels 23, 24 at each end 21, 22 of the wraparound carton 11 are glued or otherwise fastened together so that, in effect, the wraparound carton provides a single closed package for the cans 12 therewithin.

Figure 2:
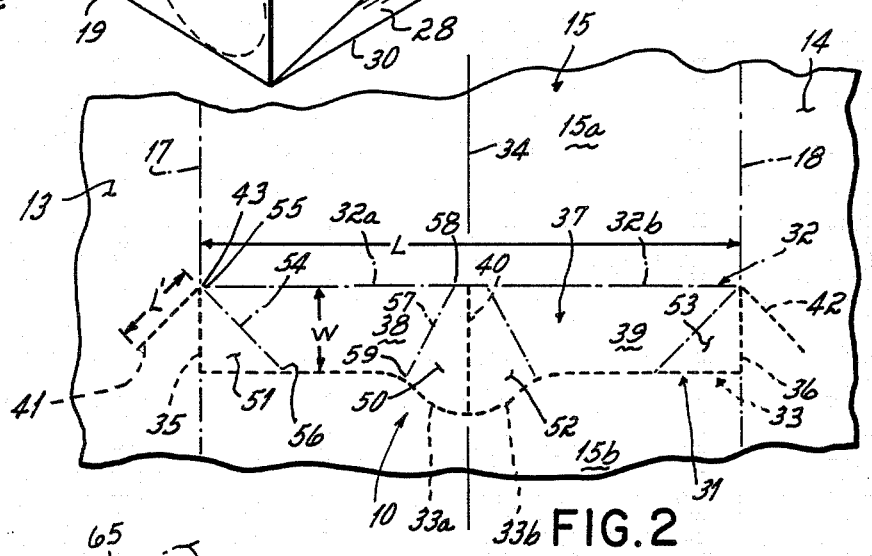
FIG. 2 is an enlarged top view of a section of the carton's top and side panels in the carrying handle area with the carton being shown in blank form, i.e., prior to folding into an erected carton; and, FIG. 3 is a perspective view similar to FIG. 1 but illustrating the handle in opened configuration as opened by a user.

The carrying handle 10 of this invention, with the carton in blank or non-erected configuration, is illustrated in FIG. 2. As thereshown, the blank includes the top wall panel 15 and two side wall panels 13, 14 hinged thereto on parallel fold lines 17, 18. A single elongated handle hole 31 is defined in the top panel 15, that handle hole being defined by a fold line 32 and a first breakaway cut line 33, both transverse to the panel's longitudinal axis 34, and both parallel one to the other. The handle hole 31 also is defined by second and third breakaway cut lines 25, 36 that are co-extensive with the top wall panel's side edges or fold lines 17, 18. Thus the handle hole 31 so defined has a width W and a length L sufficient to permit a user's fingers to be received therein underneath either top panel portion **15*a* or top panel portion 15*b* when a carton of containers, e.g., cans 12 is being carried by the user. More particularly, the length L of the handle hole 31 is exactly equal to the width of top panel 15. And the handle hole 31 as defined by cut lines 33, 35, 36 and hinge line 32 thereby defines a handle flap 37**.

The handle flap 37 so defined is separable into two sub-flaps 38, 39 by means of a fourth breakaway cut line 40 that extends longitudinally between the transverse cut line 33 and the handle flap's hinge line 32, which longitudinal cut line 40 is co-axial with the longitudinal axis 34 of the top wall panel 15. The hinge lines **32*a*, 32*b* for the two sub-flaps 38, 39 are co-axial one with the other, and that hinge line 32 extends all the way across the top panel 15 between the top wall panel's side edges 17, 18. Accordingly, and when the carton's user wishes to snap open the handle flap 37 from the as-manufactured configuration shown in FIG. 1 to the use configuration shown in FIG. 3, the handle flap 37 is broken away from the top panel 15 along the end cut lines 35, 36, and the transverse cut line 33, as well as the center cut line 40, to define the two sub-flaps 38, 39 which pivot or hinge on the transverse hinge lines 32***a*, 32*b*.

Another feature of the carrying handle 10 includes a breakaway cut line 41 formed in side wall panel 13 and a breakaway cut line 42 formed in side wall panel 16, each cut line 41, 42 being of a length L′ equal to the width W of the handle flap 37, and being positioned at about a 45° angle relative to the flap's hinge line 32 when viewed in the FIG. 2 blank configuration. These angled cut lines 41, 42 each terminate, as at 43, at the top wall panel's respective side edges 17, 18 where they intersect the respective end cut lines 35, 36 at the respective ends of the flap's hinge line 32 all as shown in FIG. 2. These side wall panel cut lines 41, 42 may or may not break away as a can filled carton 11 is being lifted by a user. But the side wall panel cut lines 41, 42 are indeed designed to break away if the stress introduced into the carton 11 itself, due to the weight of the cans 12 packaged in the carton, cause it as the carton is being lifted by a user.

A further feature of the carrying handle 10 includes deflectable or foldable ears 50, 51 at the inner and outer ends of sub-flap 38, and deflectable or foldable ears 52, 53 at the inner and outer ends of sub-flaps 39. The deflectable ears 51, 53 at the outer ends of sub-flaps 38, 39 are upwardly deflectable, and are each defined by a score line 54 that terminates at one end 55 at the intersection of hinge line 32 and a fold line 17 or 18 and at the other end 56 on the cut line 33. These outer hinge ears 51, 53 deflect upwardly to permit the two sub-flaps 38, 39 to be more easily folded under the top wall panel 15, i.e., minimize the interference between the sub-flaps and the adjacent side wall panels 13, 14, when the handle flap 37 is being stripped out of the top wall panel by the carton's user. the deflectable ears 50, 52 at the inner ends of the sub-flaps 38, 39 are each defined by a score line 57 that terminates at one end 58 on the sub-flap's hinge line 32*a* or 32*b* and at the other end 59 on the transverse cut line 33. The sub-flaps' inner hinged ears 50, 52 are adapted to deflect downwardly when the user's finger provides a downward force 60 on the surface area defined by those inner ears 50, 52, thereby making it easier to begin punching out the handle flap 37 for the user. So the flaps' inner hinged ear 50, 52 structure, in combination with the longitudinal cut line 40, enhances initial breakaway of the two handle sub-flaps 38, 39 from the top wall panel 15 and, thereby, makes it easier for the user to use the carton by subsequently fully breaking away the two handle subflaps from that top wall panel.

In use, and as illustrated in FIG. 3, the handle flap 37 has only a single fold line 32, so in order to break the flap away and bend it under the carton's top wall panel 15 the user's hand 65 is oriented as shown in that figure with the user's fingers 61–64 being pointed in a direction toward the cut line 33 and away from the fold line 32. With the user's hand 65 so oriented, the user's middle finger 62 first presses down in the area of the flap's inner ears 50, 52, thereby starting the breakaway of those inner ears along cut line 40 and adjacent sections 33*a*, 33*b* of the cut line 33. The user's first finger 61 on one side of the longitudinal cut line 40 and the user's third 63 and fourth 64 fingers on the other side of that cut line 40, continue to press down adjacent the sub-flaps 38, 39, respectively, until they too are fully broken away from the top wall panel 15, and until they are bent or folded underneath the top panel's section 15*a*. As the user's middle finger 62 pushes down on the flaps' inner ears 50, 52, those ears bend or fold downwardly along fold lines 57, and as the sub-flaps 38, 39 continue the broken away the outer ears bend or fold upwardly along fold lines 54. With the sub-flaps 38, 39 broken away entirely from end cut lines 35, 36 and transverse cut line 33, and with those flaps folded underneath the top panel section 15*a*, the wraparound carton 11 can be easily carried as shown simply by the user's fingers 61–64 being inserted underneath that panel section 15*a* in order to lift up the carton. As previously mentioned, and in the event the stress induced in the side wall panels 13, 14 of the wraparound carton 11 demands it, one or both of side wall cut lines 41, 42 can break away partially or fully in order to minimize the chances of tearing the paperboard carton's top 15 and/or side 13, 14 wall panels.

Having described in detail the preferred embodiment of my invention, what I desire to claim and protect by Letters Patent is:

1. A carton with carrying handle, said carton having a top wall panel having opposed side edges and a longitudinal axis, a side wall panel being connected on a fold line to each of said side edges, said handle comprising a first breakaway cut line disposed substantially transverse to said top wall panel's longitudinal axis, and a hinge line also disposed substantially transverse to said top wall panel's longitudinal axis, second and third breakaway cut lines that connect said transverse cut line and said hinge line at the ends thereof, all of said cut lines and said hinge lines cooperating to define a handle flap foldable beneath said top wall panel, and cooperating to define a handle hole that permits a user's fingers to be received therethrough when said carton is being carried by a user, a fourth breakaway cut line that extends between said first cut line and said hinge line, said fourth cut line permitting said handle flap to be sub-divided into two sub-flaps as said handle flap is broken away from said top wall panel, each of said sub-flaps having an outer end adjacent a side edge of said top wall panel and an inner end located between said top wall panel's side edges, said sub-flaps' inner ends being adjacent to one another and said sub flaps' outer ends constituting the ends of said handle flap, and an inner ear hinged at said inner end of at least one sub-flap, said inner ear being adapted to deflect downwardly when a user's finger begins pushing toward the interior of the carton in that general area defined by that inner hinged ear as said handle flap is broken away from said top wall panel.

2. A carton set forth in claim 1, said carton comprising a breakaway cut line formed in at least one side wall panel that, when said top wall panel and said side wall panel are co-planar, is positioned at about a forty-five degree angle relative to said handle flap's hinge line, and that extends into said side wall panel from the handle flap's hinge line where said hinge line terminates on the fold line of said side wall panel with said top wall panel.

3. A carton as set forth in claim 2, said side wall panel's cut line being angled toward said first cut line, relative to the longitudinal axis of said top wall panel, when said top wall panel and said side wall panel are co-planar.

4. A carton as set forth in claim 1, at least one of said sub-flaps comprising an outer ear hinged at said outer end of said sub-flap, said outer ear being upwardly deflectable as said sub-flap is folded beneath said top wall panel to minimize interference of said sub-flap with that side wall panel to which said outer ear is adjacent.

5. A carton as set forth in claim 1, the hinge lines for each of said sub-flaps being co-axial one with the other.

* * * * *

UNITED STATES PATENT AND TRADEMARK OFFICE

CERTIFICATE OF CORRECTION

PATENT NO. : 4,784,316

DATED : November 15, 1988

INVENTOR(S) : Elmoe Crouch

It is certified that error appears in the above-identified patent and that said Letters Patent is hereby corrected as shown below:

Column 2, line 28 delete "23, 14" and insert -- 23, 24 --.

Column 2, line 46 delete "25, 36" and insert -- 35, 36--.

Signed and Sealed this

Tenth Day of April, 1990

*Attest:*

HARRY F. MANBECK, JR.

*Attesting Officer*

*Commissioner of Patents and Trademarks*